US006561203B2

(12) United States Patent
Kajiura et al.

(10) Patent No.: US 6,561,203 B2
(45) Date of Patent: May 13, 2003

(54) CONTAINER CLEANING, DRAINING AND DRYING APPARATUS

(75) Inventors: Masatoshi Kajiura, Kawasaki (JP); Mitsuhide Tanaka, Kawasaki (JP)

(73) Assignee: Ajinomoto Co., Inc., Tokyo (JP)

( * ) Notice: Subject to any disclaimer, the term of this patent is extended or adjusted under 35 U.S.C. 154(b) by 0 days.

(21) Appl. No.: 09/773,910

(22) Filed: Feb. 2, 2001

(65) Prior Publication Data

US 2001/0029972 A1 Oct. 18, 2001

(30) Foreign Application Priority Data

Feb. 8, 2000 (JP) ..... 2000-031227

(51) Int. Cl.[7] ..... B08B 3/02

(52) U.S. Cl. ..... 134/127; 134/131; 134/169 R; 134/166 R; 134/125

(58) Field of Search ..... 134/166 R, 166 C, 134/169 R, 131, 127, 125

(56) References Cited

U.S. PATENT DOCUMENTS 2,380,984 A * 8/1945 Moeller
2,461,162 A * 2/1949 Laird
3,336,722 A * 8/1967 Winden
4,152,464 A * 5/1979 Brody et al.
4,208,852 A * 6/1980 Pioch
4,296,068 A * 10/1981 Hoshino
4,409,775 A * 10/1983 Brody et al.
4,530,202 A * 7/1985 Powell et al.
5,174,430 A * 12/1992 Ebira
5,857,309 A * 1/1999 Chica et al.

* cited by examiner

*Primary Examiner*—Frankie L. Stinson
(74) *Attorney, Agent, or Firm*—Oblon, Spivak, McClelland, Maier & Neustadt, P.C.

(57) ABSTRACT

Herein is disclosed a container cleaning, draining and drying apparatus comprising: a transfer mechanism for transferring a container filled with a content; a cleaning mechanism for cleaning an outer surface of the container during the transfer; a draining mechanism for draining the cleaning liquid; and a drying mechanism for drying the outer surface of the container which performs cleaning with good efficiency to completely remove the content or filler stuck onto the outer surface, folded parts or the like of the container in a short time during the container transfer, and momentarily draining and drying the remaining cleaning liquid used.

9 Claims, 3 Drawing Sheets

CONTAINER CLEANING, DRAINING AND DRYING APPARATUS

BACKGROUND OF THE INVENTION

1. Industrial Field of the Invention

The present invention relates to a continuous automatic apparatus for cleaning, draining and drying containers which apparatus can continuously supply, clean, drain, dry and take out containers whose outer surfaces have been stained during the previous manufacture process of container-filled products.

2. Prior Art

Japanese Patent Application Laid-Open (Kokai) No. 7758/1994 discloses a container cleaning/drying apparatus comprising: a supply mechanism for supplying reversed and laminated containers one by one onto a chain conveyor from a supplying lifter; a container transfer mechanism; a container cleaning mechanism; a draining/drying mechanism; a reversing/relocating mechanism for subsequently reversing the containers and laminating the reversed containers onto the lifter; and a taking-out mechanism. On the other hand, in connection with the container cleaning method, on a belt conveyor for conveying containers, the outer surface of the bottom of a container is cleaned in a half laid down state of the container. However, this method suffers from disadvantages that fine parts or details cannot sufficiently be cleaned and that the belt conveyor is submerged. Particularly, in a charging or filling method of continuously charging or filling a liquid material such as a healthy nutritious food with a high nutritive value, an enteral nutrient, or the like into a cylindrical roll, cutting and molding the roll into a container, whereby container-charged products are produced, there are such problems that it is difficult to clean cut parts, and that stuck residues escaping the cleaning are unhygienic and may stain the belt conveyor, and there are other problems with respect to product management and process management.

SUMMARY OF THE INVENTION

[Problems to be Solved by the Invention]

It is an object of the present invention to develop an apparatus which can efficiently clean and completely remove the filler or content stuck, upon charging or filling a filler or content into a container, onto outer surface(s) of the container, bent part(s) of the container, cut surface(s) for molding the container and the vicinity thereof, in a short time during transferring the container, and momentarily can drain and dry the cleaning liquid.

[Means for Solving the Problem]

As a result of their intensive researches to solve problems, the present inventors have found that one of the problems can be solved by cleaning from below, the outer surface of the bottom of a container when the container is to be cleaned. For that purpose, the container transferring mechanism comprises a pair of right and left endless belts whereby containers are transferred with two side surfaces of each container being catched with the pair of endless belts and with the bottom surface of each container being exposed, during their transferring. They have further found that when cleaning nozzles, draining nozzles and drying nozzles are disposed from above and below containers in transfer, the dirt or stain on a container outer surface can be removed to such an extent that there is no problem in quality management. On these findings they have completed the present invention.

Accordingly, the present invention relates to a container-cleaning, draining and drying apparatus which comprises a transfer mechanism for transferring content or filler-charged or filled containers with the outer surfaces of their bottom being exposed, a cleaning mechanism for cleaning the outer surfaces of the containers during the transfer, a draining mechanism for draining the cleaning liquid, and a drying mechanism for drying the said outer surfaces of the containers.

DESCRIPTION OF REFERENCE NUMERALS

Figure 1:
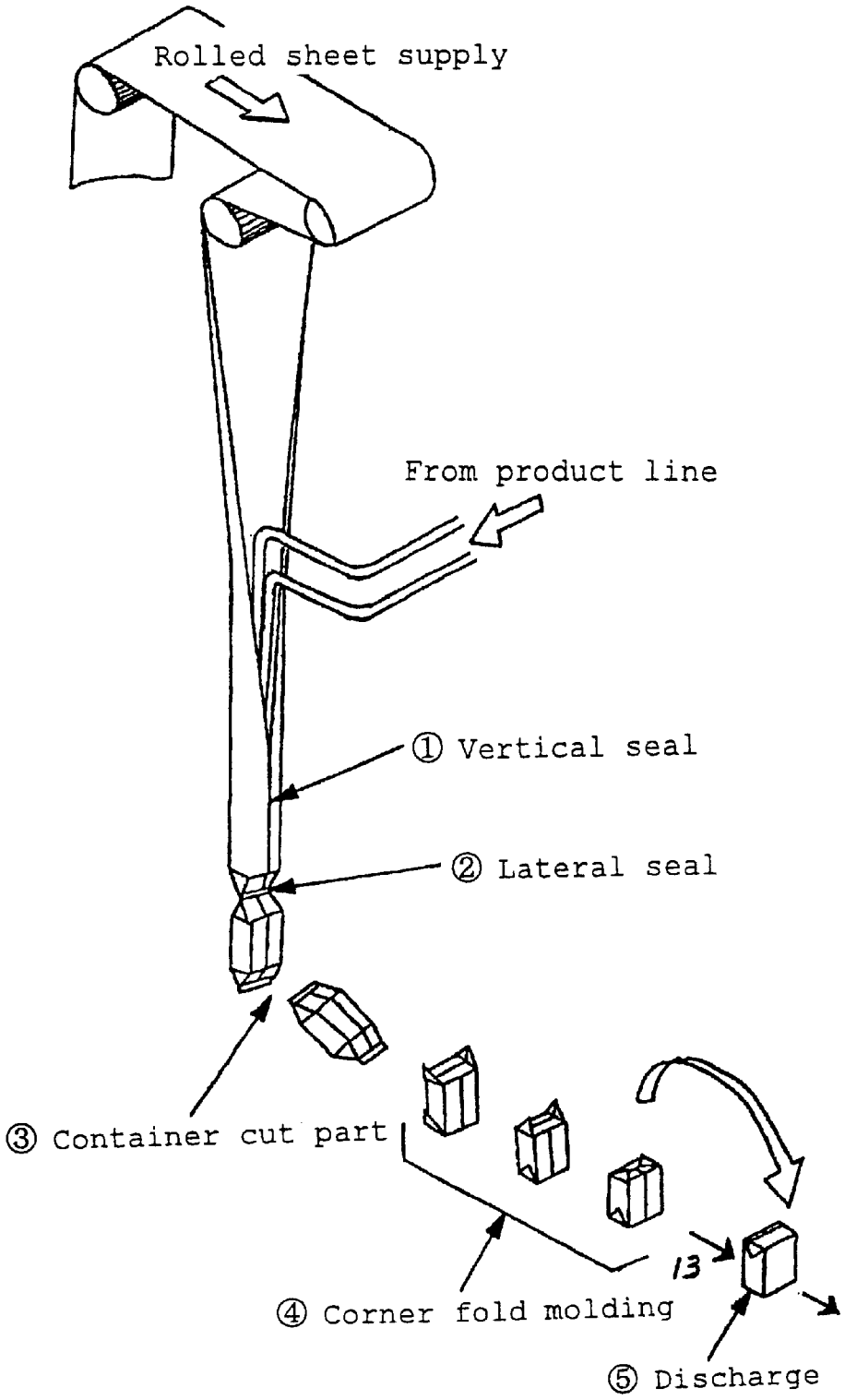
FIG. 1 shows an example of a mechanism for charging a liquid medical food into a container.

1 Endless belt
2 Guide rail
3 Support guide rail
4 Cleaning mechanism (apparatus)
5 Draining mechanism (apparatus)
6 Drying mechanism (apparatus)
7 Cleaning nozzle
8 Draining nozzle
9 Drying nozzle (high blow nozzle)
10 Hood
11 Amplitude adjuster
12 Guide rail distance adjuster
13 Belt conveyor

DETAILED DESCRIPTION OF THE INVENTION

Containers after charged or filled with a content or filler and sealed are transferred on a belt conveyor to a container-cleaning, draining and drying apparatus of the present invention. The containers are transferred from the belt conveyor to the transfer mechanism of the container-cleaning, draining and drying apparatus of the present invention. The process comprises molding containers, charging the containers, and transferring the charged containers onto a belt conveyor are not particularly limited and can be conventionally carried out. An example of such process will be shown in FIG. 1.

The transfer mechanism, one of the mechanisms constituting the apparatus of the present invention, comprises a pair of right and left endless belts. A content-charged container is transferred by the mechanism, with two sides thereof being catched with the pair of endless belts, the catching being, in turn, strengthened with guide rails supporting the endless belts, and with the outer surface of the bottom thereof being exposed. The distance or width between the guide rails is adjusted with guide rail distance adjusters.

The transfer mechanism is a mechanism for transferring charged or filled containers to the cleaning mechanism, draining mechanism and drying mechanism successively, while being transferred. The transfer mechanism is structured in such way that all or most part of a container bottom onto which the content most easily sticks when charged, is exposed so as to facilitate respective process operations and raise efficiencies at the respective mechanisms. For that purpose, the mechanism comprises a pair of endless belts to catch a container at two side surfaces thereof and transfer the container and guide rails disposed outside the endless belts, the guide rails serving to hold the container from beneath to such an extent that the container fails to drop. The distance between the two guide rails can be adjusted with guide rail distance adjusters. Moreover, by disposing, below the endless belt(s), L-shaped, cylindrical or another type support guide rail(s) for supporting the bottom of the container, a weighty container can sufficiently be handled. Endless belt (s) may be disposed on both sides, or on one side with the other side being a guide rail side wall. By supporting the container in these manners, the cleaning of the top and bottom surfaces of the container is facilitated.

The cleaning mechanism is a mechanism for cleaning containers after charged with the content, by removing the remaining content stuck onto the outer walls or surfaces, folded part(s), cut part(s) and the vicinity thereof of the containers. The cleaning can be performed by using cleaning nozzles to spout a cleaning liquid, but it is important to select the function and shape of the cleaning nozzle in such a manner that the dirt or remaining content can be more efficiently removed even from every detail and corner. For this purpose, a cleaning nozzle of such a type that the cleaning nozzle vibrates during cleaning, is preferably used. In the cleaning mechanism, it is preferred that the cleaning nozzle can be adjusted in height and can be arbitrarily changed in nozzle angle. Examples of this nozzle type include "Patagun pw-200" type manufactured by K. K. Kikuchi, and the like. Since these cleaning nozzles are provided with an amplitude adjuster, the nozzle tip end vibrates with an amplitude during spouting the cleaning liquid or drying air. Furthermore, by changing the adjuster position, an amplitude width of the cleaning nozzle tip end can be changed. Therefore, the cleaning liquid or the drying air forms a vibrating jet flow, thereby providing an advantage/effect that the dirt can be removed from every detail and corner with respect to various shapes.

The cleaning nozzles are disposed above and below the endless belts as the transfer mechanism. The upper and lower cleaning nozzles are not required to be positioned above and below, in the same position across the transfer direction. Preferably, the upper cleaning nozzle is rather disposed, in the transfer direction, before the lower cleaning nozzle, whereby the draining can be effected more effectively and the cleaning liquid can hardly remain.

In order to raise the cleaning efficiency, the cleaning liquid may be selected in accordance with the properties of the material or content charged in containers. Pure water, tap water, or a solution containing a detergent suitable for the content charged or filled is usually used. Cleaning conditions may appropriately be set in accordance with the stained or dirt situation. And, concerning usual dirt or stains, a jet pressure can be in a range of 0.1 to 10 kgf/cm$^2$, and cleaning time can be of the order of several to 30 seconds.

When cleaning is not sufficiently performed while containers are transferred through the cleaning mechanism, an optical sensor or the like is used to adjust the speed of the endless belts so that the cleaning time can be lengthened. Moreover, by operating the endless belts intermittently or measuring the container position to temporarily stop the endless belts, the cleaning time can also be lengthened.

The draining mechanism is disposed subsequent to the cleaning mechanism, and is a mechanism for removing the cleaning liquid remaining on the surfaces of containers after cleaning. The draining can be performed by using draining nozzles to spout dry air, but in order to more efficiently remove the remaining cleaning liquid even from every detail and corner, it is important to select the function and shape of the draining nozzles, as in the case of the cleaning nozzle. For this purpose, a draining nozzle of such a type that the draining nozzle vibrates during draining, is preferably used. In the draining mechanism, it is preferred that the draining nozzle can be adjusted in height and can be arbitrarily changed in nozzle angle. Examples of this type of nozzle include preferably "Patagun PU-120 type", "Patagun PZ-180 type", "Patagun PR-300 type", and "Patagun PU-200 type" all manufactured by K. K. Kikuchi, "SPGR-1A type" manufactured by Taiko Kennetsu K. K., and the like.

The draining nozzles are disposed next to the cleaning nozzles and above and below the endless belts as the transfer mechanism. The upper and lower draining nozzles can be similarly positioned in the transfer direction, but if the upper draining nozzle is positioned before the lower draining nozzle, the draining efficiency is improved. Conversely, if the lower draining nozzle is positioned before the upper draining nozzle, such disadvantage occurs that the cleaning liquid splashed by the upper draining nozzle goes down the side surfaces of the container to be accumulated on the outer surface of the bottom thereof. The draining may be effected more effectively by first spouting dry air from the draining nozzle in the upper position to splash the cleaning liquid, and then spouting dry air from the lower draining nozzle to splash the cleaning liquid on the outer surface of the bottom of the container.

Jet conditions of dry air for draining may appropriately be set in accordance with the wet situation with the cleaning liquid. And, in usual cases, the jet pressure can be in a range of 0.1 to 10 kgf/cm$^2$, and cleaning time can be of the order of several to 30 seconds.

When draining is not sufficiently performed while containers are transferred through the draining mechanism, an optical sensor or the like is used to the adjust the speed of the endless belts so that the draining time can be lengthened. Moreover, by operating the endless belts intermittently or measuring the container position to temporarily stop the endless belts, the draining time can also be lengthened.

The drying mechanism is disposed in the rearmost part in the transfer mechanism, and is a mechanism for drying the cleaning liquid still remaining after draining. The drying can be performed by using drying nozzles to spout hot dry air, but in order to more efficiently dry every detail and corner, it is necessary to select the function and shape of the drying nozzle to a certain degree. As the drying nozzle, for example, "High Blow Nozzle 40AL-300-1-S1" manufactured by K. K. Takeko Seisakusho, "KT-400 type", "DM-300 type" and "DM-300B type" all manufactured by K. K. Kikuchi, and the like can be used.

In the transfer mechanism, the drying nozzles are disposed in the upper position and downward position. The upper and lower drying nozzles are similarly positioned in the transfer direction, and there are no special reasons for disposing the upper nozzle to deviate from the lower nozzle forward and backward.

Jet conditions of hot dry air for drying may appropriately be set. And, concerning usual drying, a jet flow rate can be in a range of 0.1 to 10 $m^3$/min, hot air temperature can be in a range of 30° C. to 300° C., and drying time can be of the order of several to 30 seconds. In this case, the drying mechanism is preferably provided with drying nozzles for spouting a hot gas.

In a case in which drying is not sufficiently performed while containers are passed through the drying mechanism, an optical sensor or the like is used to adjust the speed of the endless belts so that the drying time can be lengthened. Moreover, by operating the endless belts intermittently or measuring the container position to temporarily stop the endless belts, the drying time can also be lengthened.

When a content or filler such as juice, wine and the like is charged into a paper container, the content liquid coloring matter dirties or stains the outer surface(s), container folded part(s), cut surface(s) for molding the container and the vicinities thereof, of the container. However, there has heretofore been no effective measure for preventing such coloring matter from dirtying or staining, and the problem has been solved by illustrating or coloring such container outer surface(s), and the like to set the coloring matter dirt or stain to be inconspicuous. With respect to the content or filler liquid coloring matter dirt or stain caused during charging juice, wine or the like into such paper container, the problem can be solved by using the cleaning, draining and drying mechanisms of the present invention to wash away the coloring matter of the dirtied or stained part(s), according to the present invention.

Moreover, the mechanisms of the present invention is effective even for cleaning and drying the outer surface(s) of a container having any complicated form. As one example in the conventional art, with respect to the container bottom surface(s) of a standing pouch for use in a retort-packed food, and the like, being dirtied or stained, it has been difficult to uniformly and thoroughly perform the cleaning, draining and drying, but the problem can be solved by using the cleaning, draining and drying mechanisms (apparatus) of the present invention.

EXAMPLES

The present invention will hereinafter be described in detail by way of examples, but is not limited to the examples.

Charging Example of Liquid Medical Food

In a nutritious food-charging/packing line, a liquid medical food was charged into 47 mmL×73 mmW×38 mmD (125 ml container).

The charging process is shown in FIG. 1. The container is formed by vertically sealing a rolled sheet ①, subsequently charging the liquid medical food, performing lateral sealing in that state ②, and subsequently cutting the container ③. Furthermore, container corners are folded and molded ④, and the container is conveyed with the belt conveyor 13 to be discharged ⑤ and moved onto the transfer mechanism of the container-cleaning, draining and drying apparatus of the present invention.

The liquid medical food had, as the main components, protein, lipid, sugar, mineral, vitamin and emulsifier. This liquid medical food was substantially neutral in pH. Since a liquid medical food reservoir is formed in the sealed part during the lateral sealing step ② of the charging process, the liquid medical food remains stuck onto the cut part upon the container cutting ③. Since the remaining liquid medical food stains the outer wall(s) of the container, and also exists in the folded parts during the corner fold molding step ④ of the charging process, it is indispensable to clean the outer wall(s) and folded part(s) of the container.

Example 1

Figure 2:
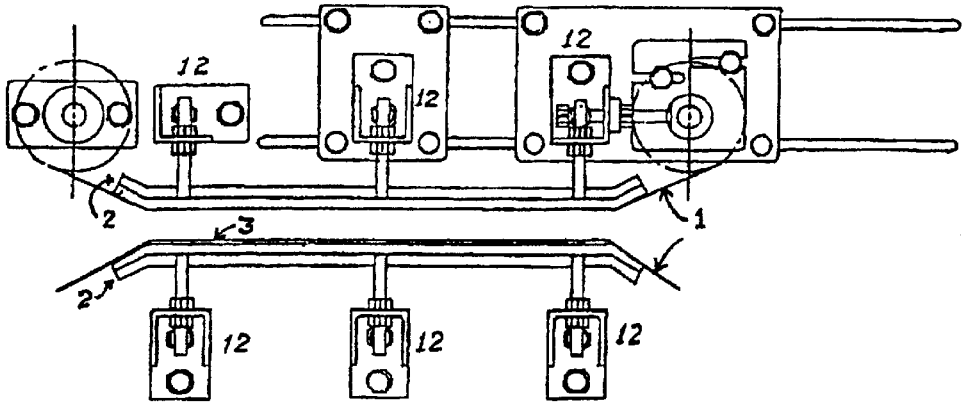
FIG. 2 is the view from over of a transfer mechanism for transferring charged containers through the cleaning, draining and drying mechanisms.

A container cleaning, draining and drying apparatus of the present invention is shown in FIG. 2.

Figure 3:
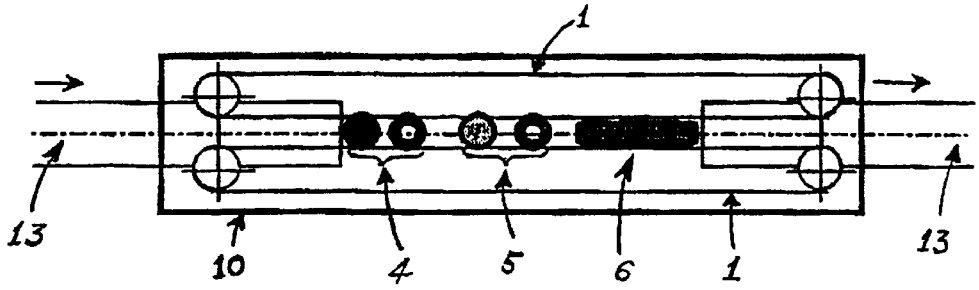
FIG. 3 is a schematic view of a container cleaning, draining and drying apparatus seen from above.
Figure 4:
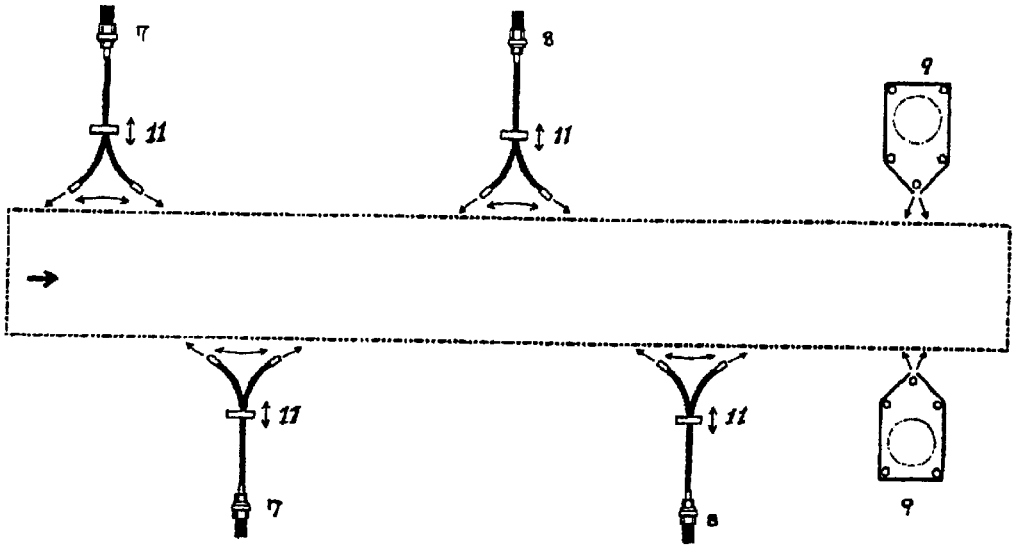
FIG. 4 is a schematic view from side of a positional relation among the respective pairs of upper and lower cleaning, draining and drying apparatuses (mechanisms) which fulfill the respective functions of the container cleaning, draining and drying apparatus, and the respective apparatus nozzle shapes.

As for guide rails 2, the distance or width between the two guide rails can be adjusted with the use of guide rail distance adjusters 12, in accordance with the container width of containers to be transferred. To prevent containers from dropping, an L-shaped support guide rail 3 is disposed beneath one of the guide rails. Each guide rail is provided with an endless rotary belt for conveying containers. Furthermore, the apparatus is provided with apparatuses 4, 5 and 6 which serve as cleaning, draining, and drying mechanisms, respectively, in this order from the top as shown in FIG. 3. FIG. 3 is a view of the apparatus as seen from above. A hood 10 is disposed to prevent cleaning liquid from splashing in all directions. FIG. 4 is a view of a cleaning apparatus 7, a draining apparatus 8 and a drying apparatus 9 as seen from the side. Each apparatus is formed of a pair of upper and lower apparatuses to efficiently act on the top and bottom surfaces of a container. Additionally, the cleaning and draining apparatuses are arranged in such way that the upper apparatus acts earlier in the container advancement direction. This can allow the cleaning liquid to efficiently drop downward from above. The cleaning and draining apparatuses are provided with the specific nozzles. I.e., "Pangun PW-200 type" manufactured by K. K. Kikuchi is used for the nozzles of the cleaning apparatus, and "Pandun PU-120 type" is used for the draining nozzles. These nozzles are provided with an amplitude adjuster 11 for vibrating a nozzle tip end during spouting as a function.

Example 2

The container cleaning, draining and drying apparatus of Example 1 was disposed in connection to the belt conveyor from which the container was discharged and taken out at ⑤ of FIG. 1 referred to in Charging Example of Liquid Medical Food. The container with the liquid medical food charged therein was conveyed at a endless belt speed of 1.8 m/min, during which the upper cleaning nozzle was first operated at a water pressure of 5 kg/$cm^2$ for a cleaning time of two seconds, and one second thereafter, the lower part of the container was cleaned at a water pressure of 5 kg/$cm^2$ with the lower cleaning nozzle. Subsequently, by spouting dry air from the upper draining nozzle at a pressure of 5 kg/$cm^2$ for two seconds, and two seconds thereafter, spouting dry air from the lower draining nozzle at a pressure of 5 kg/$cm^2$ for two seconds, whereby the container outside was drained. After two seconds, to perform drying, the upper and lower outer parts of the container were substantially simultaneously exposed to the hot dry air of the drying apparatus, whereby the outside of the container was dried. The drying nozzles were "High Blow Nozzle 40AL-300-1-S1" manufactured by K. K. Taketsuna Seisakusho, and the drying was performed at a temperature of 200° C. and an air flow rate of 0.85 $m^3$/min for a time of five seconds.

Example 3

Example 2 was repeated except that the container used in Charging Example of the Liquid Medical Food was set to 94L×73W×38D (250 ml).

Comparative Example 1

Example 2 was repeated except that the apparatus of Example 1 from which apparatus the cleaning apparatus had been disconnected, and that the cleaning operation had been omitted in Example 2, accordingly.

Comparative Example 2

Example 2 was repeated except that the draining and drying apparatuses had been disconnected, and that no draining or drying operation had been performed in Example 2, accordingly.

Comparative Example 3

Comparative Example 1 was followed except that the container of Example 3 was used.

Comparative Example 4

Comparative Example 2 was followed except that the container of Example 3 was used.

Example 4

To evaluate the cleaned situations of the containers taken out in Examples 2 and 3, and Comparative Examples 1, 2, 3 and 4, bacteria such as blue mould, yeast and the like were planted onto the cut ends of the containers, and tests were carried out to confirm how bacterial propagation occurs depending upon the cleaning/drying condition.

Method and results are shown as follows.

Test method: Bacteria such as Penicillium sp, Cladosporium sp and Rhodotorula sp were used in the present test, and samples were stored for two weeks in a storage chamber kept at a temperature of 30° C. and humidity of 83%. How the containers had been cleaned and dried, was evaluated on the basis of the bacterial propagation situations on the samples after two weeks.

In this connection, there is no microorganism propagation on the samples prepared from containers satisfactory in cleaning/drying property.

Experiment results;

| | bacterial propagation |
|---|---|
| Example 2 | None |
| Example 3 | None |
| Comparative Example 1 | Present |
| Comparative Example 2 | Present |
| Comparative Example 3 | Present |
| Comparative Example 4 | Present |

Effect of the Invention

According to the present invention, the content or filler stuck to container outer surfaces, container folded parts, cut end surfaces for molding a container and the vicinity thereof when the container is charged or filled with a liquid or like material, can efficiently be cleaned in a short time and completely removed during the container transfer, and the cleaning liquid can momentarily be drained and dried.

What is claimed is:

1. A container-cleaning, draining and drying apparatus comprising:

a transfer mechanism for transferring a container filled with a content;

a cleaning mechanism for cleaning an outer surface of the container during the transfer;

a draining mechanism for draining the cleaning liquid;

and a drying mechanism for drying the outer surface of the container wherein said transfer mechanism comprises a pair of right and left endless belts having a distance therebetween which is adjustable for catching two side surfaces of the container to such an extent that the container fails to drop and comprises at least one support guide rail disposed below the endless belts, for supporting the container at a bottom side thereof.

2. The container-cleaning, draining and drying apparatus according to claim 1, wherein said cleaning mechanism comprises a jet apparatus having cleaning nozzles for spouting a cleaning liquid, wherein a tip end of the nozzles vibrates with an amplitude.

3. The container-cleaning, draining and drying apparatus according to claim 1 wherein said draining mechanism comprises a jet apparatus having drying nozzles for spouting a dry gas, wherein a tip end of said nozzles vibrates with a predetermined amplitude.

4. The container-cleaning, draining and drying apparatus according to claim 1, which comprises a hood to cover the entire apparatus, for collecting and discarding the splashed liquid by one of the cleaning mechanism, the draining mechanism, and the drying mechanism.

5. The container-cleaning, draining and drying apparatus according to claim 1 wherein said cleaning mechanism further comprises;

upper and lower cleaning nozzles wherein said upper cleaning nozzle is disposed in a transfer direction upstream of said lower cleaning nozzle.

6. The container-cleaning, draining and drying apparatus according to claim 1, wherein said jet apparatus of said cleaning mechanism comprises a mechanism for spraying at least one of pure water, tap water and a detergent solution wherein said jet pressure is in the range of 0.1 to 10 kgf/cm$^2$ and the cleaning time is between 0 to 30 seconds.

7. The container-cleaning, draining and drying apparatus according to claim 1, wherein said jet apparatus of said draining mechanism generates pressure in a range of 0.1 to 10 kgf/cm$^2$ and the cleaning time is between 0 to 30 seconds.

8. The container-cleaning, draining and drying apparatus according to claim 1, wherein said drying mechanism includes drying nozzles with jets wherein said jet flow rate is in a range of 0.1 to 10 m$^2$/min and the air temperature is in a range of 30° C. to 300° C.

9. A container-cleaning, draining and drying apparatus comprising a transfer mechanism for transferring a container filled with a content;

a cleaning mechanism for cleaning an outer surface of the container during the transfer;

a draining mechanism for draining a cleaning liquid; and a drying mechanism for drying the outer surface of the container wherein said transfer mechanism comprises a pair of right and left endless belts have a distance therebetween which is adjustable for catching two side surfaces of the container in the event the container fails to drop and comprises at least one support guide rail disposed below said endless belt for supporting the container at a bottom side thereof;

wherein said cleaning mechanism comprising a jet apparatus having cleaning nozzles for spouting a cleaning liquid, a tip end of said nozzles vibrating with a predetermined amplitude; and wherein said cleaning mechanism includes means for draining of said cleaning liquid.

* * * * *